US005947821A

United States Patent [19]

Stone

[11] Patent Number: 5,947,821

[45] Date of Patent: Sep. 7, 1999

[54] CARD GAME

[75] Inventor: Jay Stone, Las Vegas, Nev.

[73] Assignee: Casino Data Systems, Las Vegas, Nev.

[21] Appl. No.: 08/724,787

[22] Filed: Oct. 1, 1996

[51] Int. Cl.[6] ..... A63F 1/00; A63F 9/24

[52] U.S. Cl. ..... 463/13; 273/292; 463/25

[58] Field of Search ..... 273/143 R, 138.2, 273/292; 463/13, 12, 25

[56] References Cited

U.S. PATENT DOCUMENTS

| | | | |
|---|---|---|---|
| 4,695,053 | 9/1987 | Vazquez, Jr. et al. . | |
| 4,743,022 | 5/1988 | Wood | 463/13 |
| 5,019,973 | 5/1991 | Wilcox et al. . | |
| 5,033,744 | 7/1991 | Bridgeman et al. | 463/13 |
| 5,098,107 | 3/1992 | Boylan et al. . | |
| 5,100,137 | 3/1992 | Fulton . | |
| 5,255,915 | 10/1993 | Miller . | |
| 5,294,120 | 3/1994 | Schultz . | |
| 5,308,065 | 5/1994 | Bridgeman et al. | 273/274 |
| 5,332,219 | 7/1994 | Marnell et al. . | |
| 5,342,049 | 8/1994 | Wichinsky et al. . | |
| 5,356,140 | 10/1994 | Dabrowski et al. . | |
| 5,366,228 | 11/1994 | Kangsanaraks . | |
| 5,393,057 | 2/1995 | Marnell, II . | |
| 5,411,257 | 5/1995 | Fulton . | |
| 5,411,268 | 5/1995 | Nelson et al. . | |
| 5,415,404 | 5/1995 | Joshi et al. . | |
| 5,415,414 | 5/1995 | Savage . | |
| 5,431,408 | 7/1995 | Adams . | |
| 5,437,451 | 8/1995 | Fulton . | |
| 5,456,465 | 10/1995 | Durham | 273/143 R |
| 5,531,440 | 7/1996 | Dabrowski et al. . | |
| 5,531,441 | 7/1996 | Dabrowski et al. . | |

*Primary Examiner*—Benjamin H. Layno
*Attorney, Agent, or Firm*—Bernhard Kreten

[57] ABSTRACT

An apparatus and method for playing a card game which provides a player with an initial choice of selecting at least one card from a plurality of cards to be designated as a wild card. The player then receives a random first hand from a full deck of cards. The first hand of cards are compared with the designated wild card to determine all matching cards and designating all matching cards in the first hand as wild cards. The player may then be provided with the option of replacing cards in the first hand with cards remaining in the deck. All replacement cards which match the wild card will also become wild. The player is also provided with an option of buying a second wild card after a losing card hand. This provides the player with an opportunity to change a losing card hand into a winning card hand. After a winning card hand the player is provided with a double or nothing option which provides a further dynamic game exchange between player and game.

66 Claims, 18 Drawing Sheets

Table Game Layout

CARD GAME

FIELD OF THE INVENTION

The present invention relates generally to card games and, in particular, to a novel poker style card game which may be played on a gaming instrumentality or as a table game.

BACKGROUND OF THE INVENTION

Card games have been a highly popular form of entertainment for centuries. For many individuals, an added excitement of wagering and a possibility of a monetary reward serve to increase the entertainment value and desirability of the game. Card games have become especially popular with players of gaming machines.

However, existing games have limited player decision making opportunities which lessens the excitement and challenge of the game for the player. In addition, these games also have limited pay out options in terms of a monetary value and total number of possible winning combinations.

Therefore, a need exists for providing a card game in which players have a certain degree of control over the results of the game which are in the form of play options and decision making opportunities. Furthermore, it is desirable to provide a card game in which players have an opportunity, through player options, to increase pay out options in terms of a monetary value and total number of possible winning combinations.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 4,695,053 | September 22, 1987 | Vazquez, Jr., et al. |
| 5,019,973 | May 28, 1991 | Wilcox, et al. |
| 5,098,107 | March 24, 1992 | Boylan, et al. |
| 5,100,137 | March 31, 1992 | Fulton |
| 5,255,915 | October 26, 1993 | Miller |
| 5,294,120 | March 15, 1994 | Schultz |
| 5,308,065 | May 3, 1994 | Bridgeman, et al. |
| 5,332,219 | July 26, 1994 | Marnell, II, et al. |
| 5,342,049 | August 30, 1994 | Wichinsky, et al. |
| 5,356,140 | October 18, 1994 | Dabrowski, et al. |
| 5,366,228 | November 22, 1994 | Kangsanaraks |
| 5,393,057 | February 28, 1995 | Marnell, II |
| 5,411,257 | May 2, 1995 | Fulton |
| 5,411,268 | May 2, 1995 | Nelson, et al. |
| 5,415,404 | May 16, 1995 | Joshi, et al. |
| 5,415,414 | May 16, 1995 | Savage |
| 5,431,408 | July 11, 1995 | Adams |
| 5,437,451 | August 1, 1995 | Fulton |
| 5,531,440 | July 2, 1996 | Dabrowski, et al. |
| 5,531,441 | July 2, 1996 | Dabrowski, et al. |

U.S. Pat. No. 5,431,408 to Adams teaches the use of a card game with a "traveling" wild card. Initially, a first plurality of cards which are dealt to a player are selected from a deck of cards which does not include a wild card. The cards remaining after making the first deal of cards are reshuffled along with one or more wild cards to form a second collection of cards from which any additional cards dealt to the player are selected. Thus, the player has no decision making opportunity with respect to receiving a wild card nor of being guaranteed that a wild card will be received during game play. If a wild card is received during one hand, the player has the opportunity to reserve that wild card for use in a subsequent hand.

U.S. Pat. No. 5,019,973 to Wilcox, et al. teaches the use of a poker game method. The game includes accepting a first wager and dealing a plurality of cards to a player. The player then makes a second wager for an additional card which will be compared with the plurality of cards previously dealt to the player. If the additional card matches the value and/or suite of any of the previously dealt cards the matching cards in the previously dealt cards are defined as wild cards. Thus, the previously dealt cards and the defined wild cards delineate a best card hand. The best card hand is then compared with a pay out table which determines if a winning combination has been hit and the amount of the pay out, if any.

The other prior art listed above, but not specifically discussed, further catalog the prior art of which the applicant is aware. These references diverge even more starkly from the references specifically distinguished above.

SUMMARY OF THE INVENTION

The present invention is distinguished over the known prior art in a multiplicity of ways. For one thing, the present invention provides added enhancement of allowing a player to choose at least one wild card from a plurality of cards initially displayed to the player at a beginning of a card game. Thus, means are provided which may improve the player's hand prior to the player being dealt a first hand of cards. In addition, a free bonus wild card may be dealt randomly during the first hand play or after a losing hand so as to provide the player with unexpected extra play options and to increase player interest. Furthermore, the player is provided with an option to "buy" a second wild card after a losing card hand. This provides another decision making opportunity for the player and increases the probability that the player's hand will be improved thereby. A wild card chosen at the beginning of one game may be held over to a subsequent game. Moreover, the player is preferably provided with a double or nothing option at the end of a winning hand. Thus, the player is provided with yet another play option and decision making opportunity which may result in the player doubling a winning pay out for a winning hand.

In a preferred form, a player makes an initial wager to participate in the card game and may also place a side wager to participate in a chance to win a progressive jackpot, an additional jackpot or a prize based on the outcome of the card game. A plurality of cards are then displayed to the player preferably five cards, in one form of the game, face down, or in another form of the game, face up, from at least one standard 52 card poker deck. The player chooses at least one card from the plurality of cards to be designated as a first wild card. Preferably, the designated wild card is displayed in a reserved area, but all 52 cards go back into the deck.

Alternatively, once an initial wager is placed, one or more cards may appear to the player as dynamically revolving about an axis. The player then chooses at least one revolving card to be designated as the first wild card. Preferably, each revolution of any one card would result in that card changing value. For example, if the player chooses a card during one revolution it may appear as the two of clubs or alternatively, if the player chooses the same revolving card during a subsequent revolution it may appear as the king of hearts. Preferably, once the player chooses at least one revolving card that card is displayed in the reserved area as the first designated wild card. All 52 cards go back into the deck.

This entertaining enhancement of how the playing cards are displayed to the player is preferably accomplished on an electronic gaming machine.

Next, the player is dealt a first card hand, preferably a 5 card hand from a standard 52 card poker deck. Note that the poker deck includes the designated wild card. The player then selects which of the cards he/she wishes to hold (or discard depending on the format of the game). The cards not held by the player are discarded and replaced with cards remaining in the standard 52 card poker deck. This forms a resultant second hand which is compared to winning combinations on a pay table. Typically, the pay out for each resultant hand is established based on the wager amount placed by the player and the rank of the hand achieved by the player.

The present invention also includes means for randomly dealing a free bonus wild card during play of a hand or at the end of play of a losing hand. Thus, the random wild card gives the player the opportunity to make unanticipated play decisions which increases player interest.

An option of buying a second wild card at the end of a losing hand is provided which may improve the losing hand to a winning hand. The second wild card is preferably chosen in the same manner as was the initial wild card and is superimposed with the first wild card such that both cards are displayed to the player in the reserved area. The players hand is then compared to winning combinations on the pay table.

In addition, the present invention provides the player with a double-or-nothing option at the end of a winning hand. This option provides the player with the excitement of taking a chance to double his/her winnings. Preferably, a plurality of cards are dealt to the player, one face up and the remaining face down. The player chooses one of the face down cards and if this card outranks the face up card the winning pay out is doubled. If the two cards match, a "push" occurs and the player must try again. Alternatively, if the player's card fails to outrank the face up card, the player loses his/her winnings.

Furthermore, the present invention may provide a "multiplier" option which, for example, multiplies the amount of a winning pay out by a randomly generated number. The "multiplier" option may be initiated at the end of each winning hand or randomly initiated at the end of each winning hand by a random number generator means. Alternatively, a wager may be required to initiate the "multiplier" option consecutively or randomly at the end of each winning hand.

The present invention may be played on a mechanical or electronic gaming machine or as a table or board game.

OBJECTS OF THE INVENTION

Accordingly, it is an object of the present invention to provide a new and novel poker style card game: method and apparatus.

A further object of the present invention is to provide a card game as delineated supra which allows a certain degree of control over the results of the card game which are in the form of play options and decision making opportunities.

Another further object of the present invention is to provide a card game as characterized above which provides a player with the opportunity, through player options, to increase pay out options in terms of a monetary value and total number of possible winning combinations.

Another further object of the present invention is to provide a device as characterized above which is extremely durable in construction, automated for efficiency and reliable to use.

Another further object of the present invention is to provide an apparatus as characterized above which can reward a player's judgment.

Another further object of the present invention is to provide a card game as characterized above which provides options to alter a losing card hand into a winning card hand.

Another further object of the present invention is to provide a card game as characterized above which provides a double-or-nothing play option at the end of a winning hand.

Another further object of the present invention is to provide a device as characterized as above which also may include a component sometimes defined as luck.

These and other objects will be made manifest when considering the following detailed specification when taken in conjunction with the appended drawing figures.

DESCRIPTION OF PREFERRED EMBODIMENTS

Figure 1:
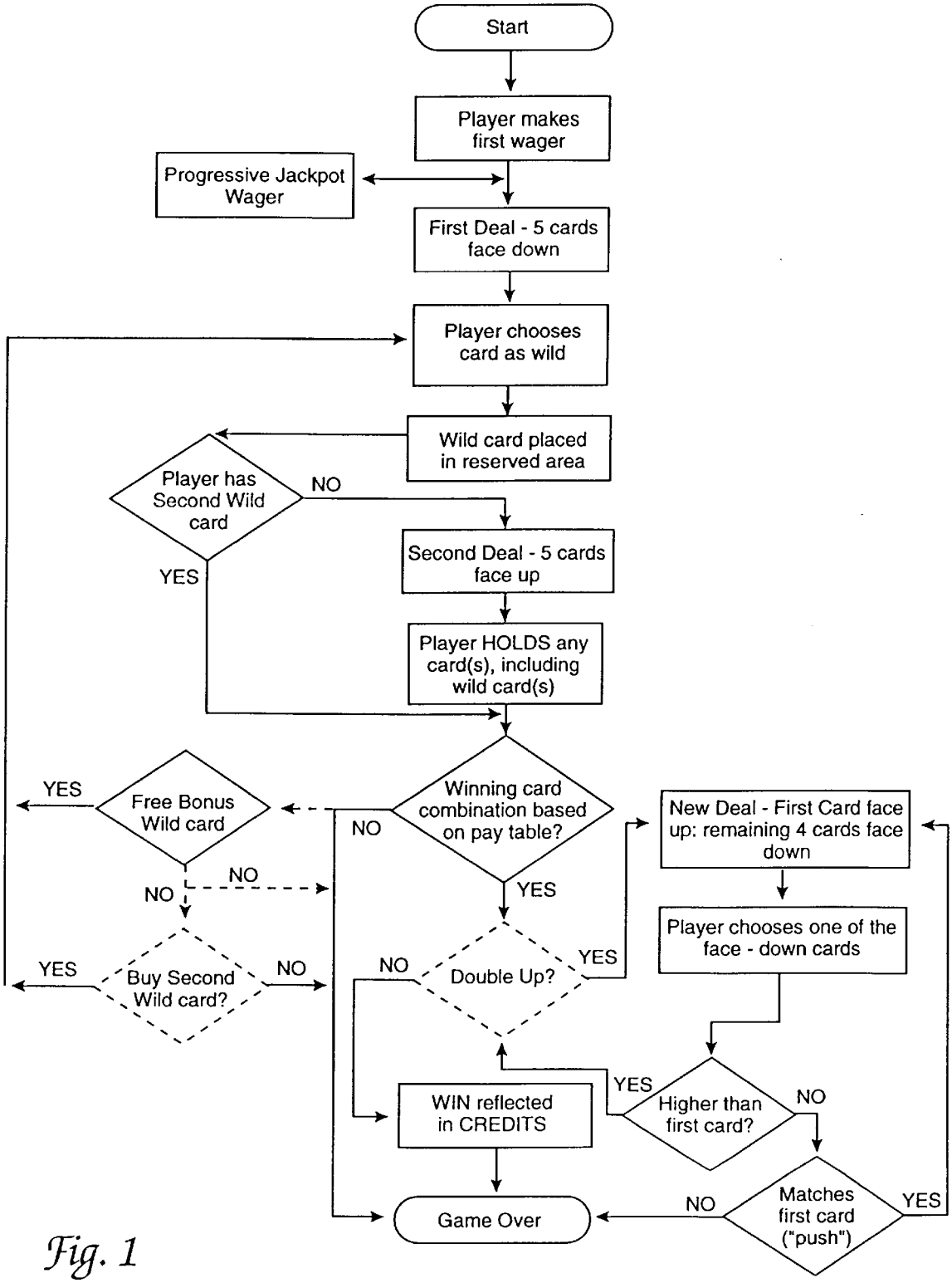
FIG. 1 is a schematic depiction of a method of playing a card game according to the present invention.
Figure 1A:
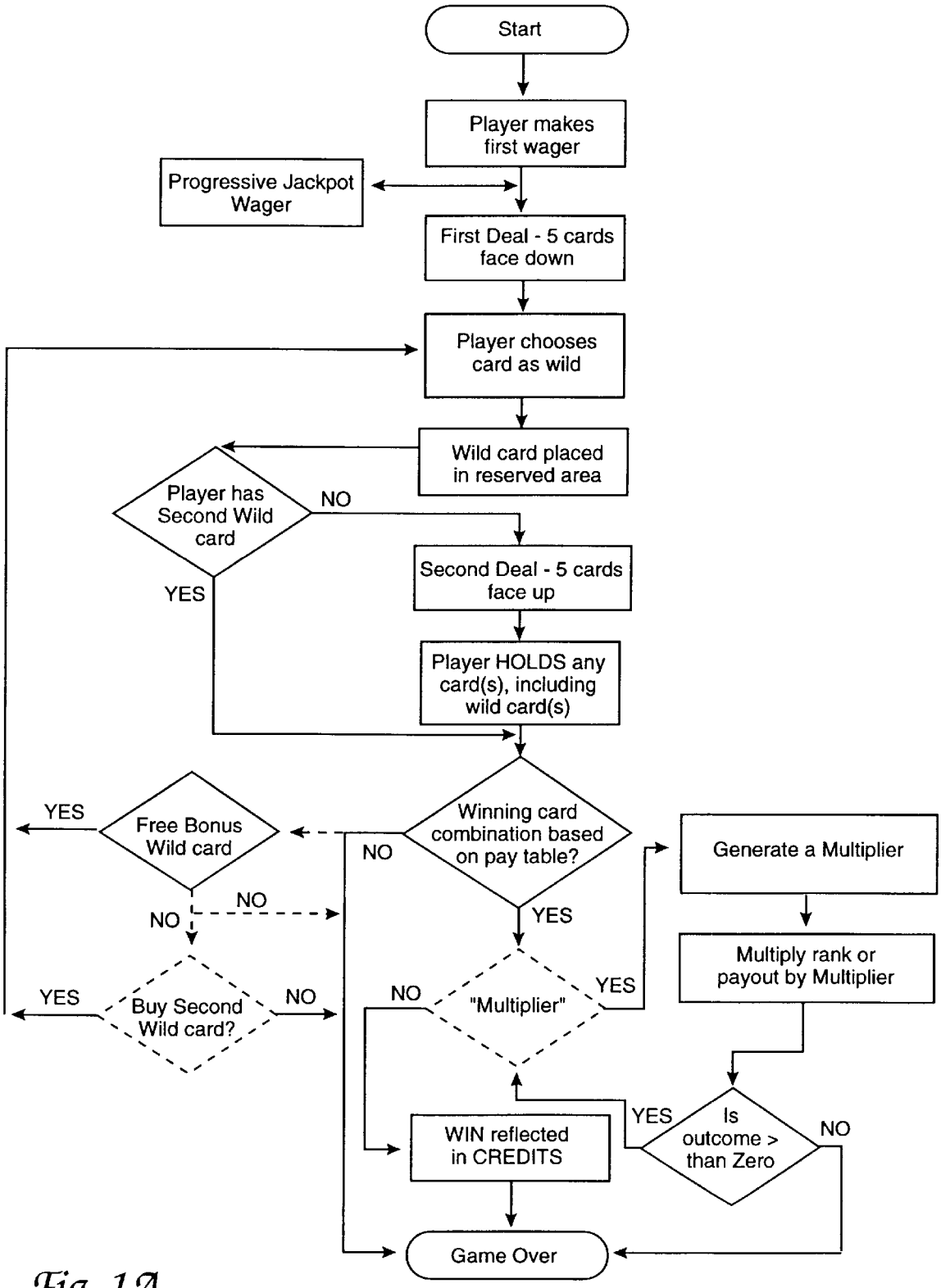
FIG. 1A is a schematic depiction of the method of playing the card game including a "multiplier" according to the present invention.

Considering the drawings, wherein like reference numerals denote like parts throughout the various drawing figures, reference numeral 10 is directed to the gaming machine according to the present invention.

Figure 2:
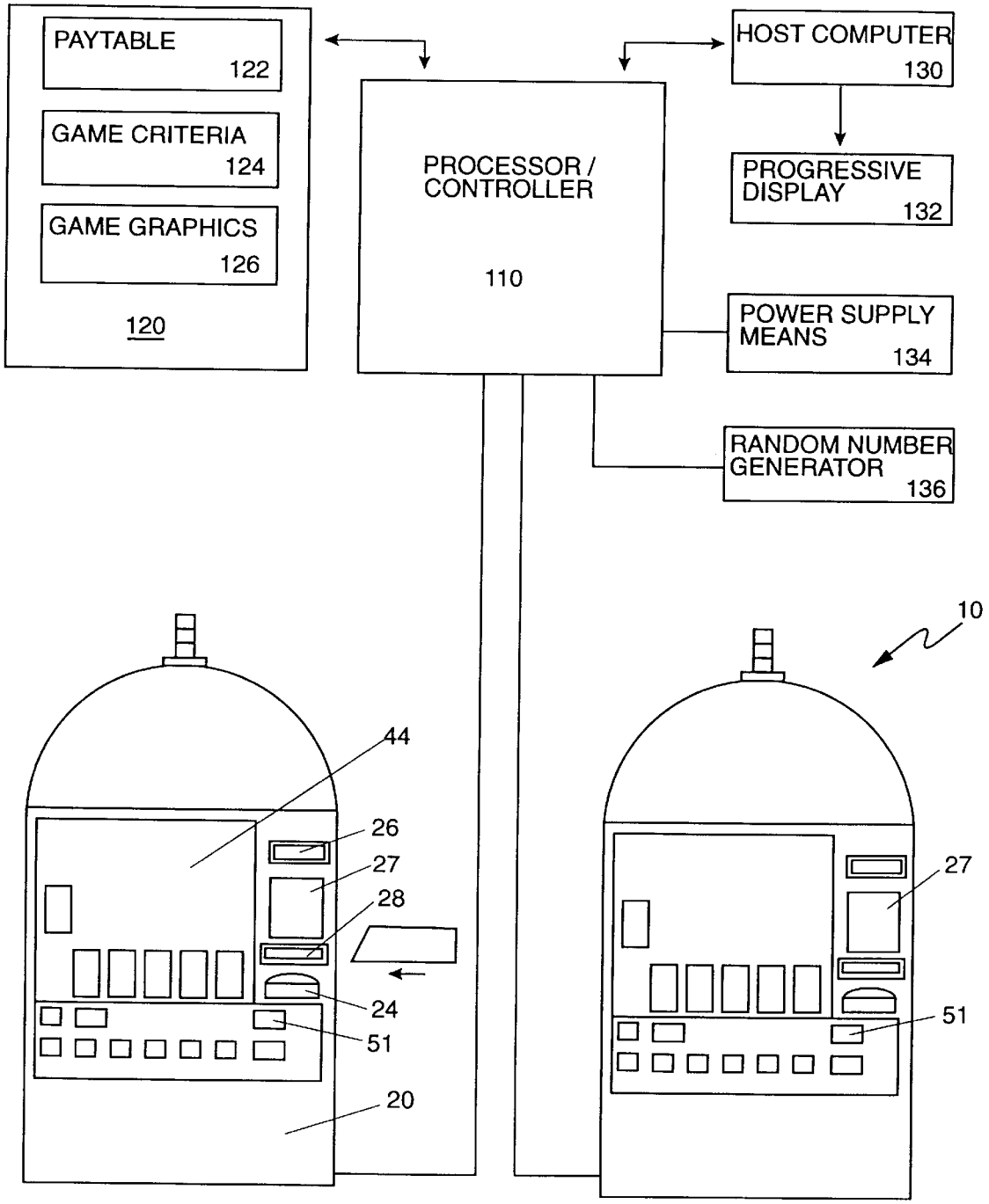
FIG. 2 is a front elevational view of a plurality of gaming machines according to one form of the present invention and upon which the method of the present invention can be played.

Referring to FIGS. 1 and 2, the gaming machine 10 includes a cabinet 20 which houses and supports a video screen 22 or other means for graphically depicting images representative of a poker game being played thereon. The video screen 22 maybe a touch screen in which play options may be selected by simply touching an image on the screen. Alternatively, play options may be selected via the operation of an input device, for example, a mouse, a keyboard, a light pen system or by push buttons. Player tracking may be provided and, inter alia, information relating to this feature may be displayed on the player tracking display 27.

Figure 3:
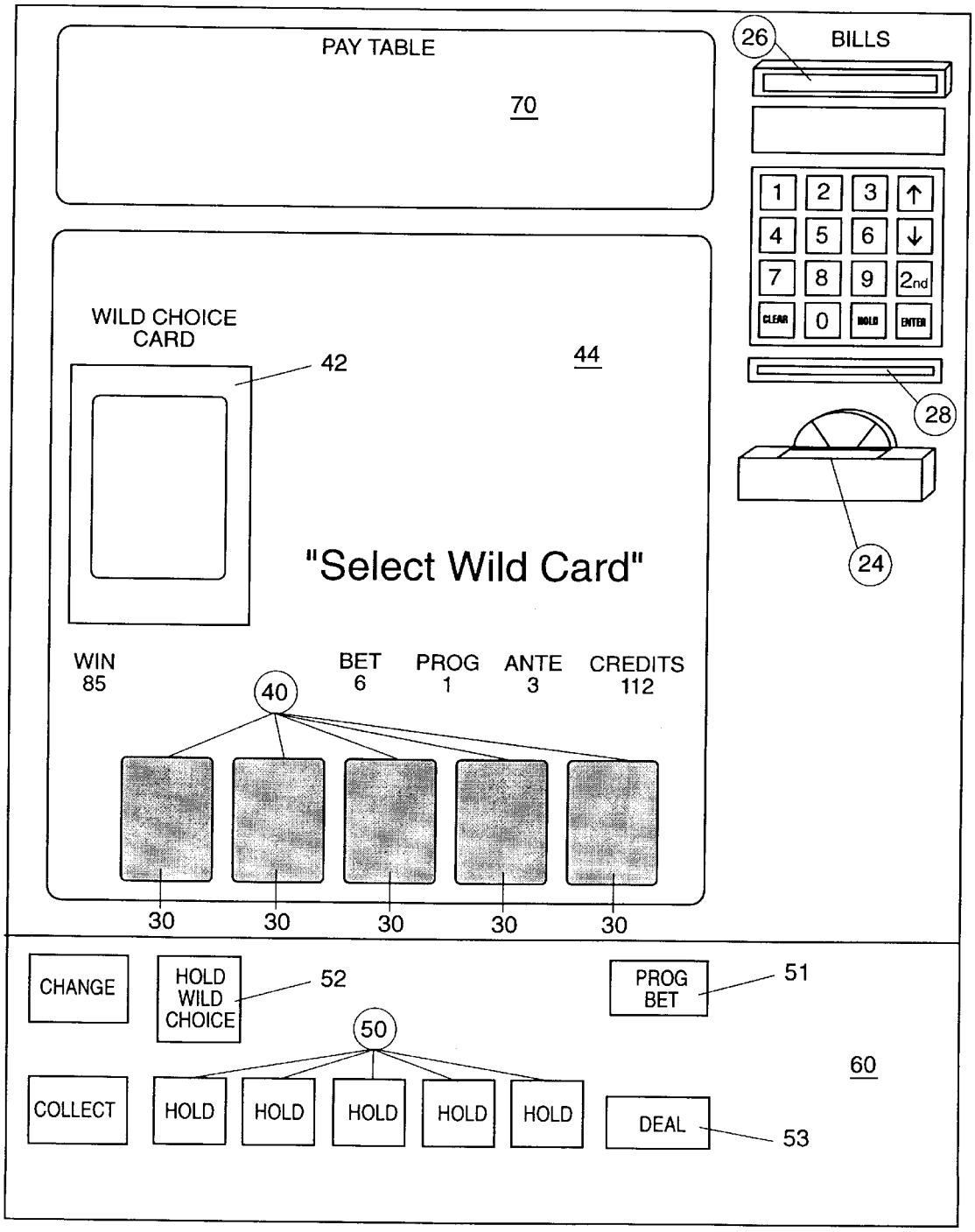
FIG. 3 is a schematic depiction of a play area of the gaming machine displaying a plurality of cards face down.

In a preferred form, a player initiates a start of the game on the gaming machine 10 through the use of inserting an item of monetary value including the following: inserting a token, which may be a coin or the like, into a slot 24, inserting a dollar bill into a bill validator 26 or by inserting or scanning a player card through a card reader 28. In addition, the player may also place a side wager to participate in a chance to win a progressive jackpot, an additional jackpot or a prize based on the outcome of the card game. Preferably, the player communicates a progressive wager via a progressive bet button 51 (FIG. 3).

Figure 3A:
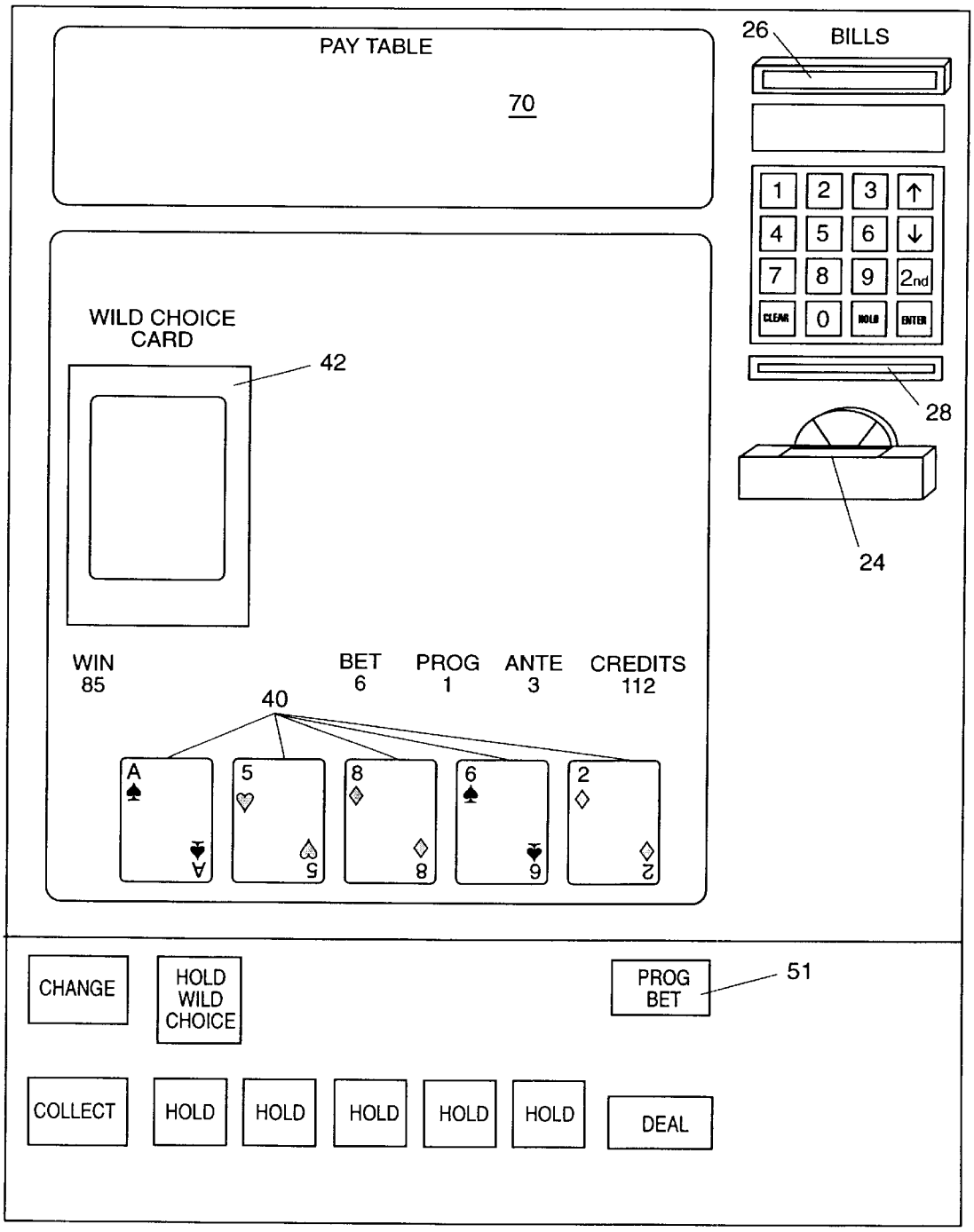
FIG. 3A is a schematic depiction of a play area of the gaming machine displaying a plurality of cards face up.
Figure 3B:
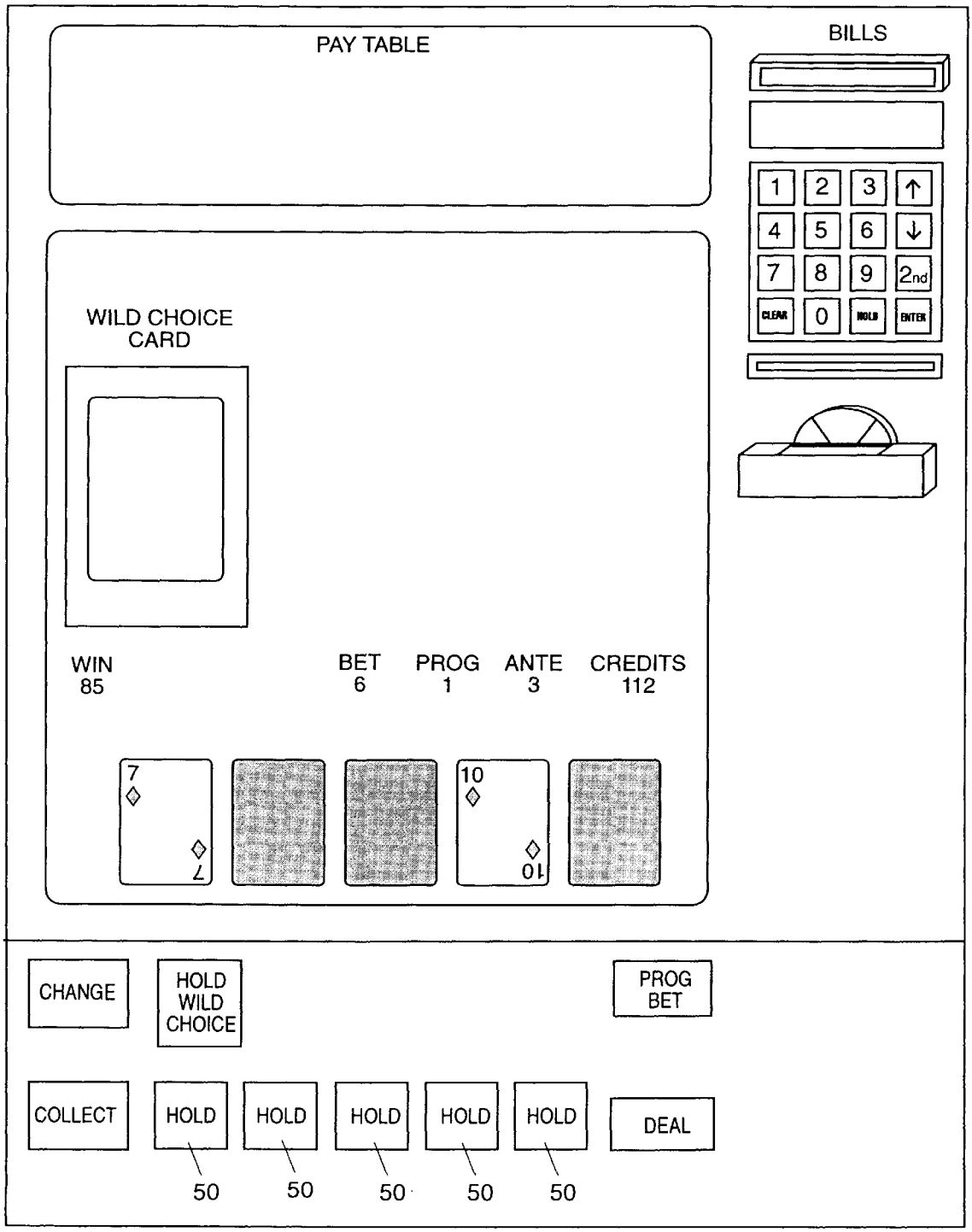
FIG. 3B is a schematic depiction of a play area of the gaming machine displaying a plurality of cards in a face up and face down combination.
Figure 3C:
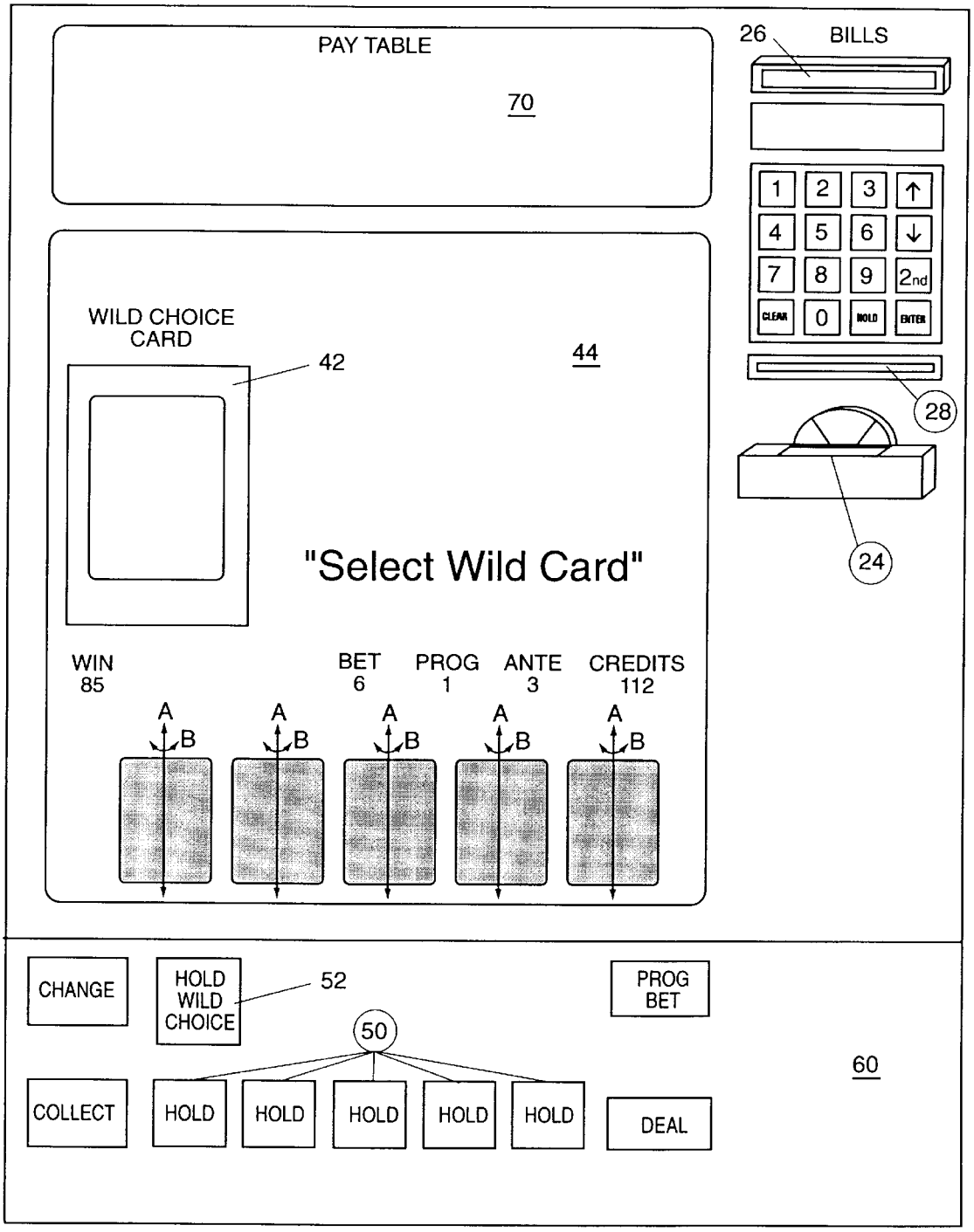
FIG. 3C is a schematic depiction of a play area of the gaming machine displaying a plurality of revolving cards.
Figure 3D:
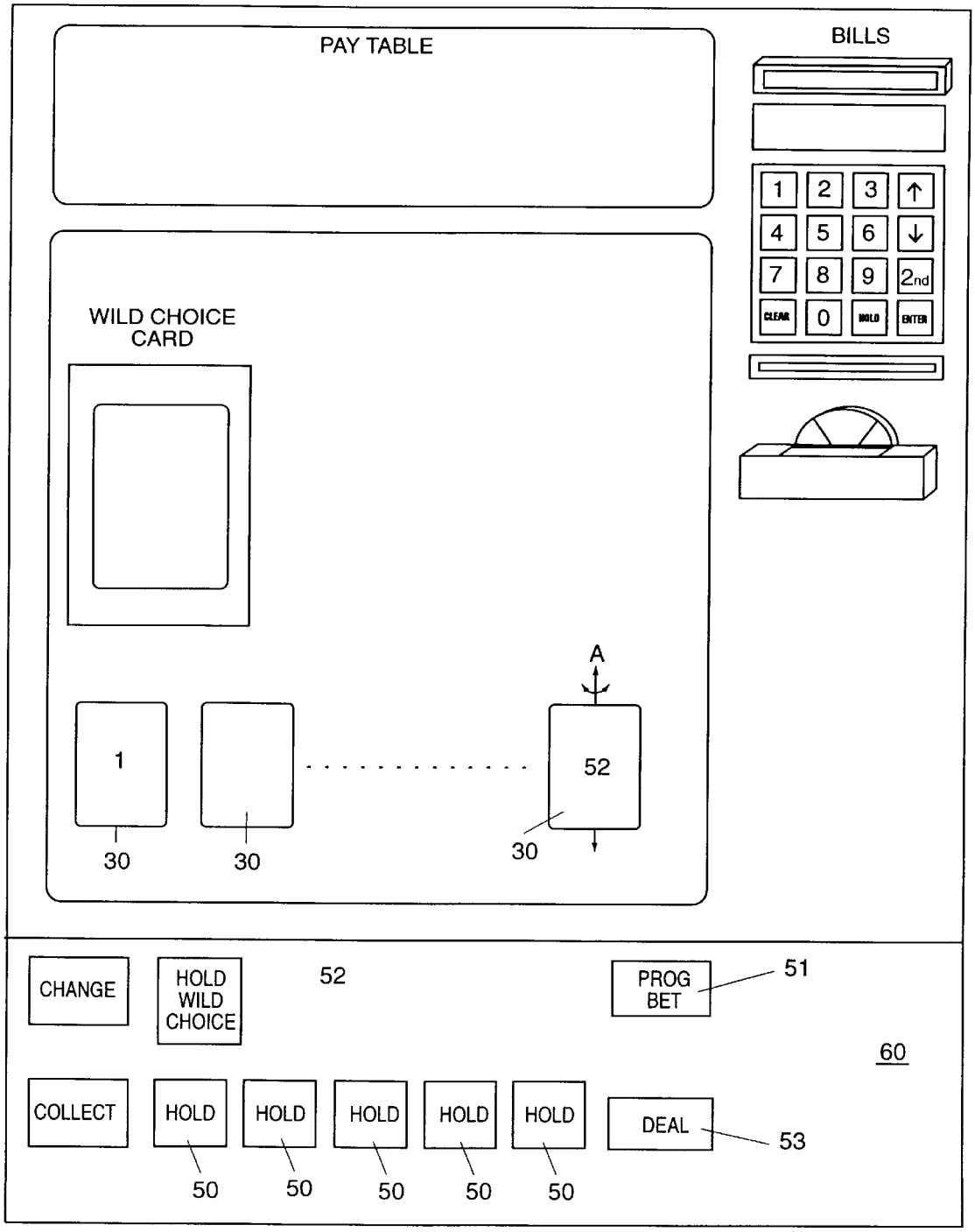
FIG. 3D is a schematic depiction of a play area of the gaming machine displaying all 52 cards of a standard poker deck.

Initiating the start of game play results in a plurality of cards 30 being displayed to a player from which the player selects at least one of the cards 30 to be designated as a wild card. For example, and referring to FIGS. 3 and 3A, five cards 30 from a standard 52 card poker deck may be displayed in windows 40 of a play area 44 either face down or face up. Alternatively, and referring to FIG. 3B, the cards 30 may be displayed in a face up, face down combination. In another form of the game, one or more cards 30 may appear to the player as rotating about axis "A" in the direction of the double ended arrow "B" (FIG. 3C). Moreover, all 52 cards may be displayed face up, face down, revolving about an axis "A" or in any combination thereof. In yet another form of the game, the plurality of cards 30 may appear to be dancing about the screen to provide an enhanced entertainment feature of the game. Preferably, the video screen 22 then displays a prompt for the player to select at least one of the cards 30 to be designated as the wild card.

Figure 4:
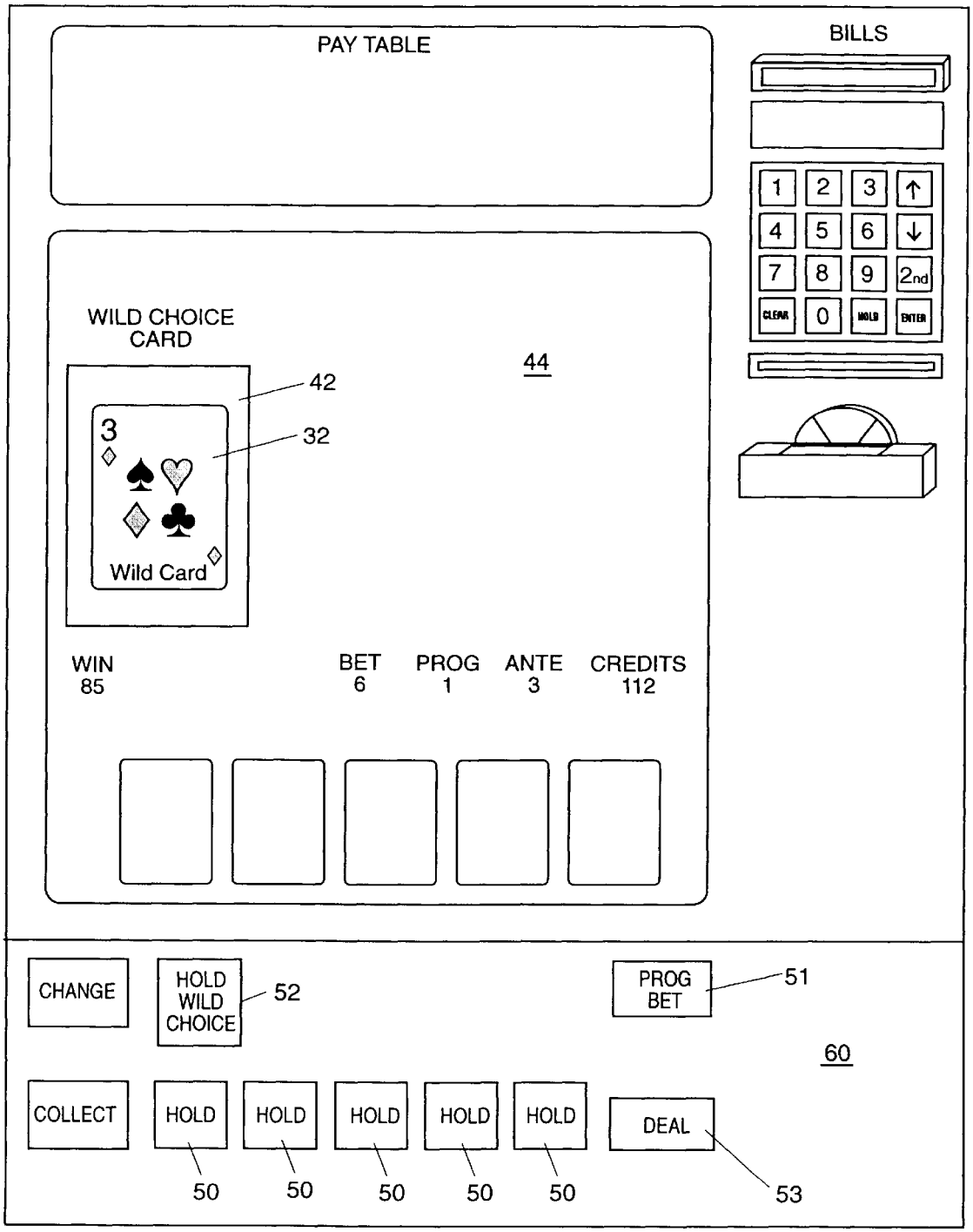
FIG. 4 is a schematic depiction of the play area of the gaming machine with a selected wild card placed in a reserved window.
Figure 11:
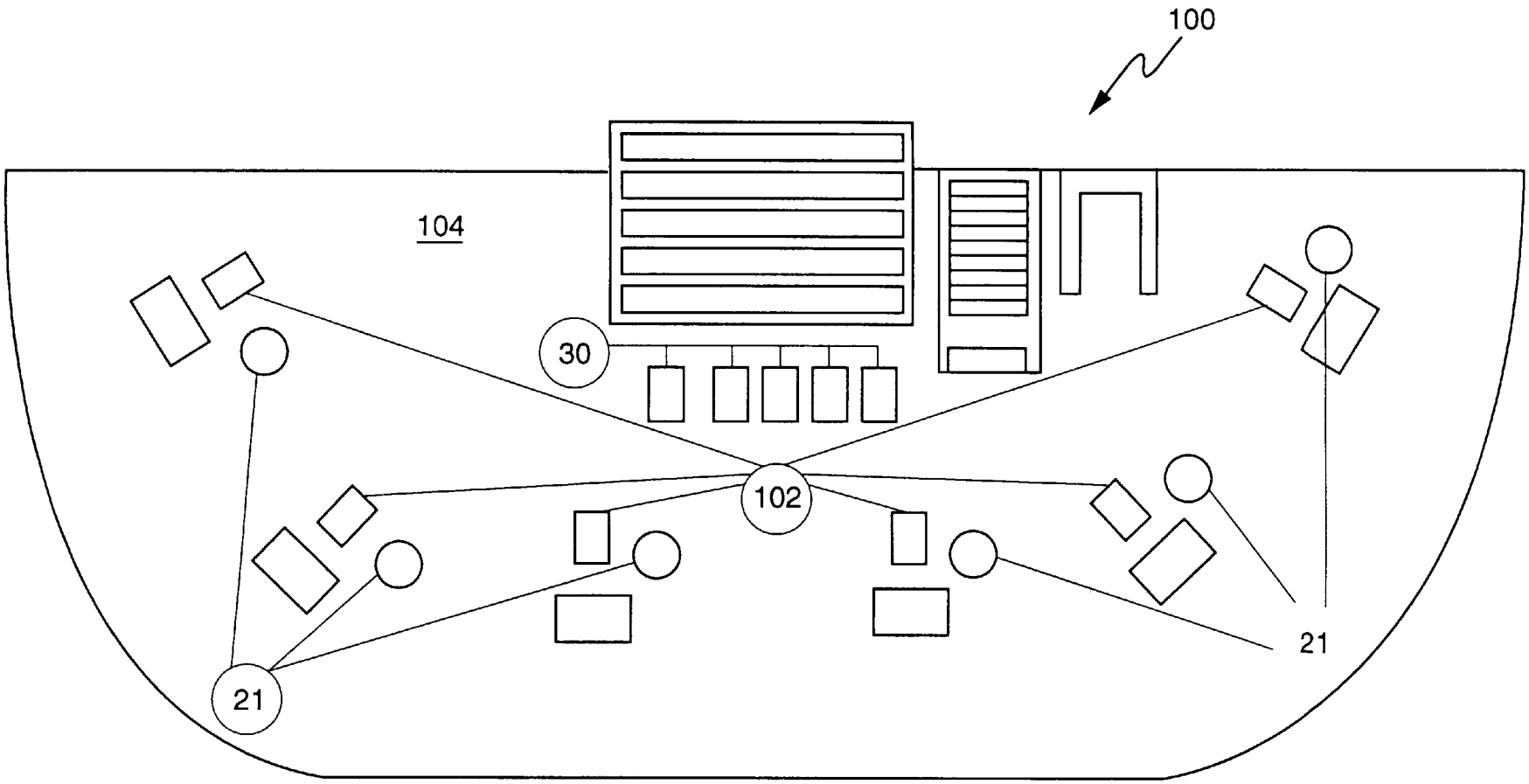
FIG. 11 is a schematic depiction of a table game embodiment of the present invention.

The player may make this selection in any of a number of ways. For example, by pressing a corresponding hold button 50 on the button panel 60, touching a desired card image on a touch screen or by turning the selected card 30 over on a gaming table 100 (FIG. 11). Referring to FIG. 4, the chosen wild card 32 is then displayed face up in a reserved area 42 of the playing area 44. On the gaming machine 10, this reserved area 42 is preferably a window in the playing area 44. In the table game 100, the reserved area may be a delineated area 102 on a playing surface 104 of the table 100.

Figure 5:
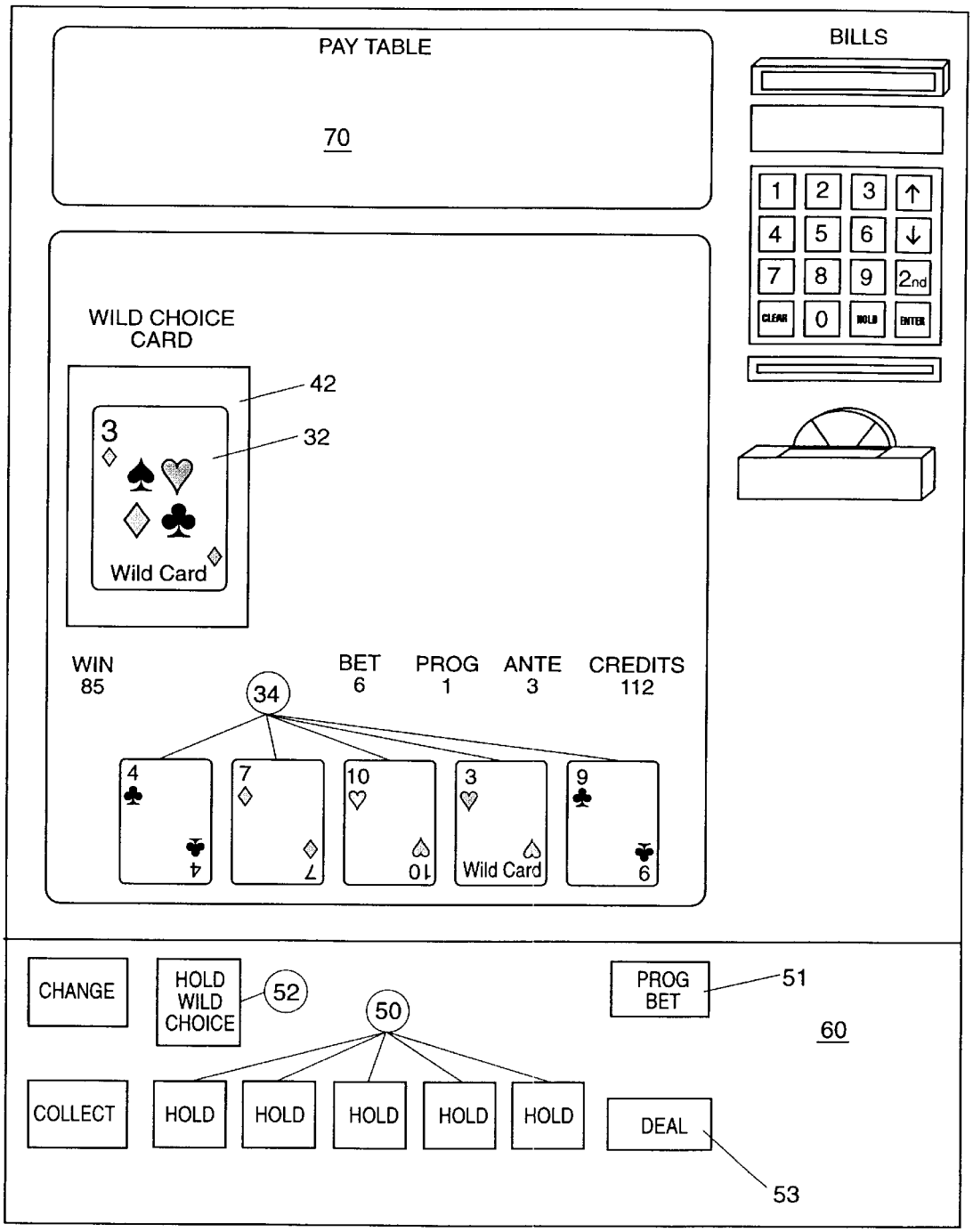
FIG. 5 is a schematic depiction of the play area of the gaming machine with the wild card placed in the reserved window and a first hand of cards dealt face up, the hand includes a matching wild card.

Referring to FIG. 4, the wild card 32 chosen by the player is a three of diamonds thus, all threes are wild. Referring to FIG. 5, after at least one wild card 32 is chosen and reserved, the player is dealt a first hand 34 of cards 30 from a full deck of cards including all designated wild cards. Preferably, the player is dealt five cards 30 upon actuation of the "deal" button 53. The cards are preferably dealt in a face up fashion so that the value and suit of the cards are known to the player. In FIG. 5, the three of diamonds makes the three of hearts in the player's hand 34 a wild card.

Once the first hand 34 of cards 30 is dealt to the player, the player has the option of holding any of the five cards 30. The player may make the selection in any of a number of ways, for example, by pressing the corresponding hold buttons 50 on the button panel 60, touching the desired card image on a touch screen or by turning over the selected card 30 on the gaming table 100 and discarding to the dealer and receiving new cards from the dealer.

Preferably, cards 30 not held by the player are automatically discarded on the gaming machine 10 or picked up by a dealer for the table game 100. The discarded cards 30 are then replaced via another deal and the resultant second hand 36 (FIG. 5*a*) is compared with a predetermined pay table 70. Typically, the pay out for each resultant hand is established based on the wager amount placed by the player and the rank of the hand achieved by the player. The pay table may rank the resultant hand on a basis of a predetermined standard poker hierarchy of ranks, for example (and in descending ranking order), a Royal Flush, a Straight Flush, Four of a Kind, Full House, Flush, Straight, Three of a Kind, Two Pair, One Pair and High Card.

The player may be given an option of holding a previously chosen wild card 32 in the previous game for use in a subsequent game. This can be accomplished by pressing a hold wild card button 52 on the button panel 60, by touching a hold wild card image on a touch screen play area, by actuating an input device on the wild card image or by placing or leaving the selected wild card 32 in the delineated area 102 on the playing surface 104 of the gaming table 100.

Figure 6:
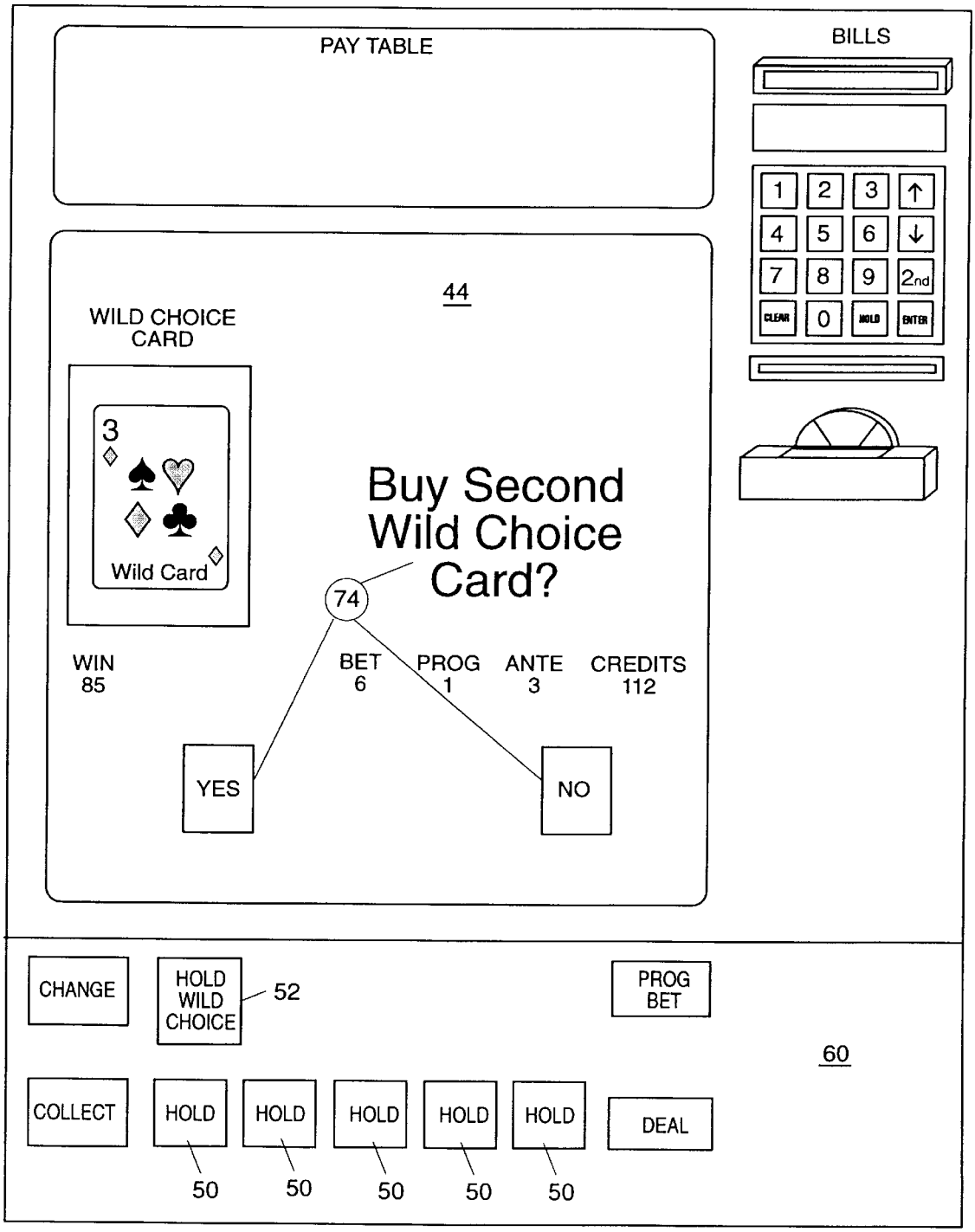
FIG. 6 is a schematic depiction of the play area of the gaming machine displaying a prompt to buy a second wild card.
Figure 7:
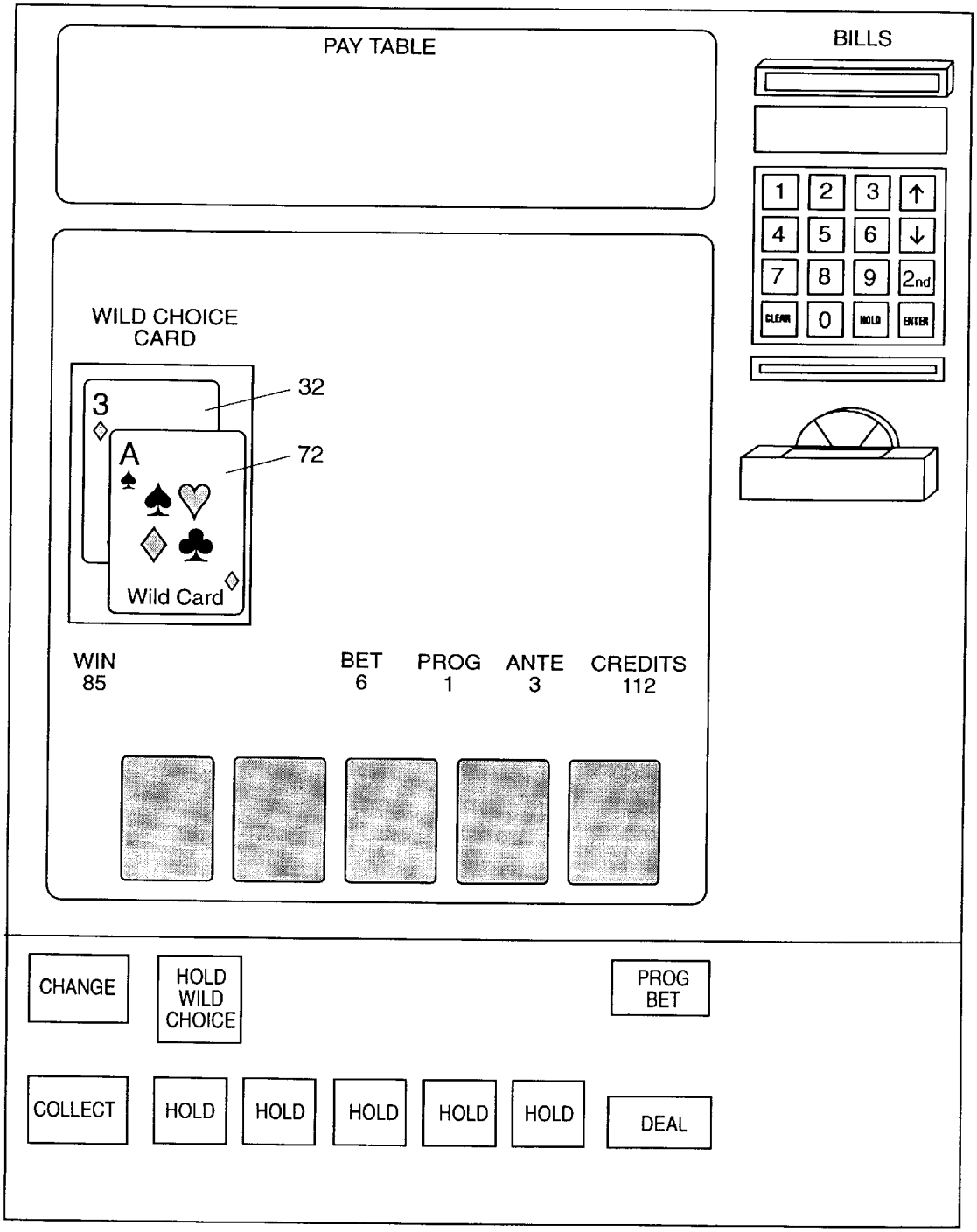
FIG. 7 is a schematic depiction of that which is shown in FIG. 6 with both wild cards added to the reserved window.

Referring to FIGS. 6 and 7, after a "losing" hand (e.g., as dictated by the pay table) the player may also be given an option to make an additional wager to "buy" a second wild card 72, which may improve the present losing hand with a winning hand. The second wild card 72 is preferably always different from the first wild card 32. Therefore, the player is provided with yet another decision-making opportunity for the player to increase the probability that a losing hand will become a winning hand.

The option of making an additional wager for a second wild card may appear as a prompt 74 in the play area 44 asking "buy second wild card?" and displaying a "yes" image above a leftmost hold button 50 and a "no" image above a rightmost hold button 50. The player communicates his/her decision by pressing the leftmost hold button 50 to respond "yes" or the rightmost button 50 to respond "no". Alternatively, the player may communicate her/his decision by touching a respective hold button image on a touch screen play area, by actuating a input device on a respective hold button image or by communicating the decision to a dealer at the table game 100. If the player communicates a "yes" response to the second wild card option the game preferably displays a plurality of cards 30 in which to choose from. The cards 30 are displayed in the same manner as they where initially displayed to the player at the outset of the card game and as is shown in FIGS. 3 and 3A through 3D. The method for choosing at least one card from the plurality of cards 30 to be designated as a second wild card is preferably the same method used for choosing the first wild card. Preferably, the second wild card 72 is placed in the reserved area 42 on the gaming machine 10 or in the delineated area 102 on the playing surface 104 of the table 100 (FIG. 11).

Figure 7A:
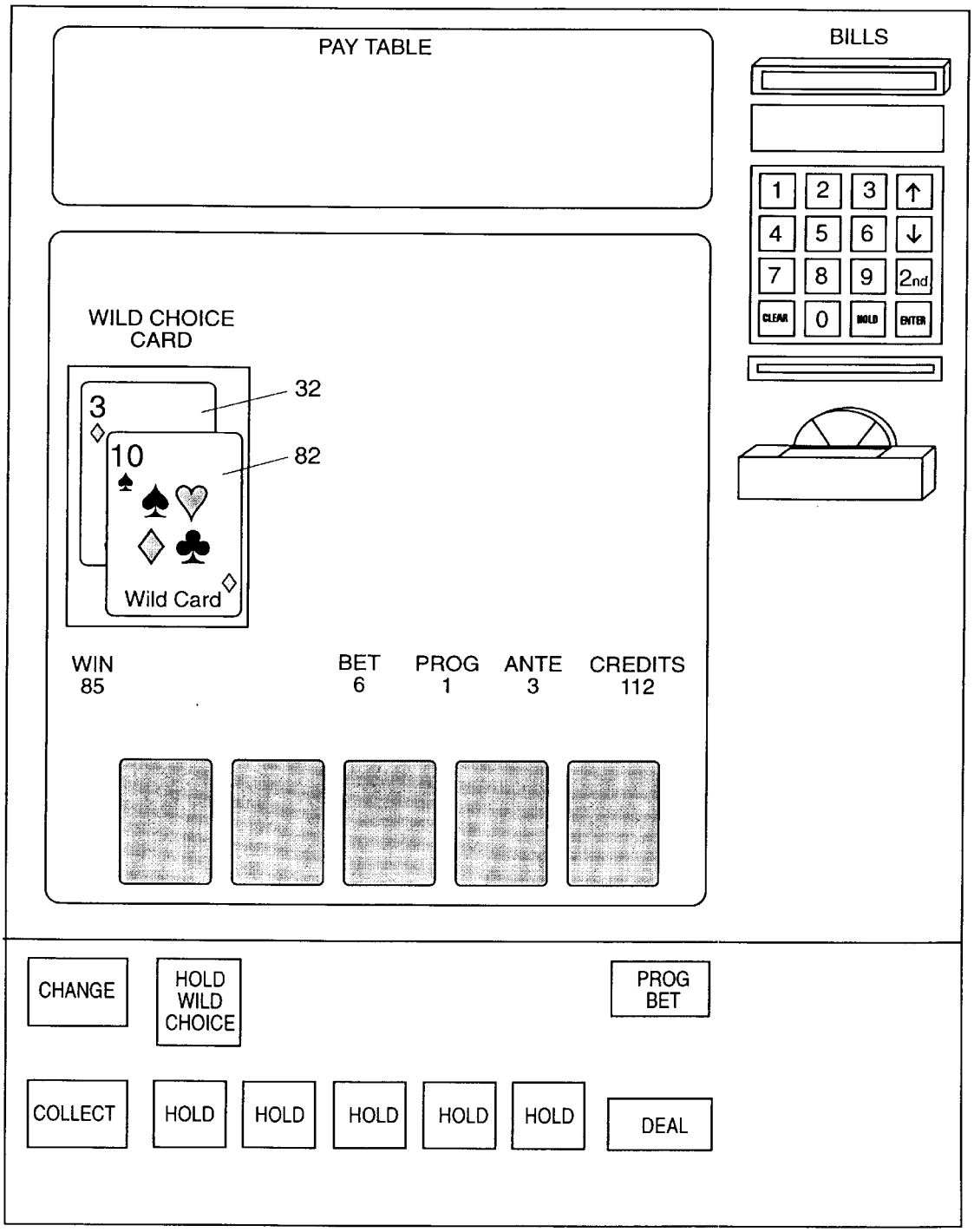
FIG. 7A is a schematic depiction of that which is shown in FIG. 6 with an additional free bonus wild card added to the reserved area.

Referring to FIG. 7A the gaming machine 10 may also include means for randomly dealing a free bonus wild card 82 (FIG. 7A) at any time during a hand or at the end of a hand. Thus, this randomly dealt bonus wild card gives the player the opportunity to make an unanticipated additional play decision. The free bonus wild card may be automatically dealt to the player or selected by the player in the same manner as the first wild card 32. Preferably, the free bonus wild card 82 is placed in the reserved area 42 or in the delineated area 102 on the playing surface 104 of the table 100 (FIG. 11).

Figure 8:
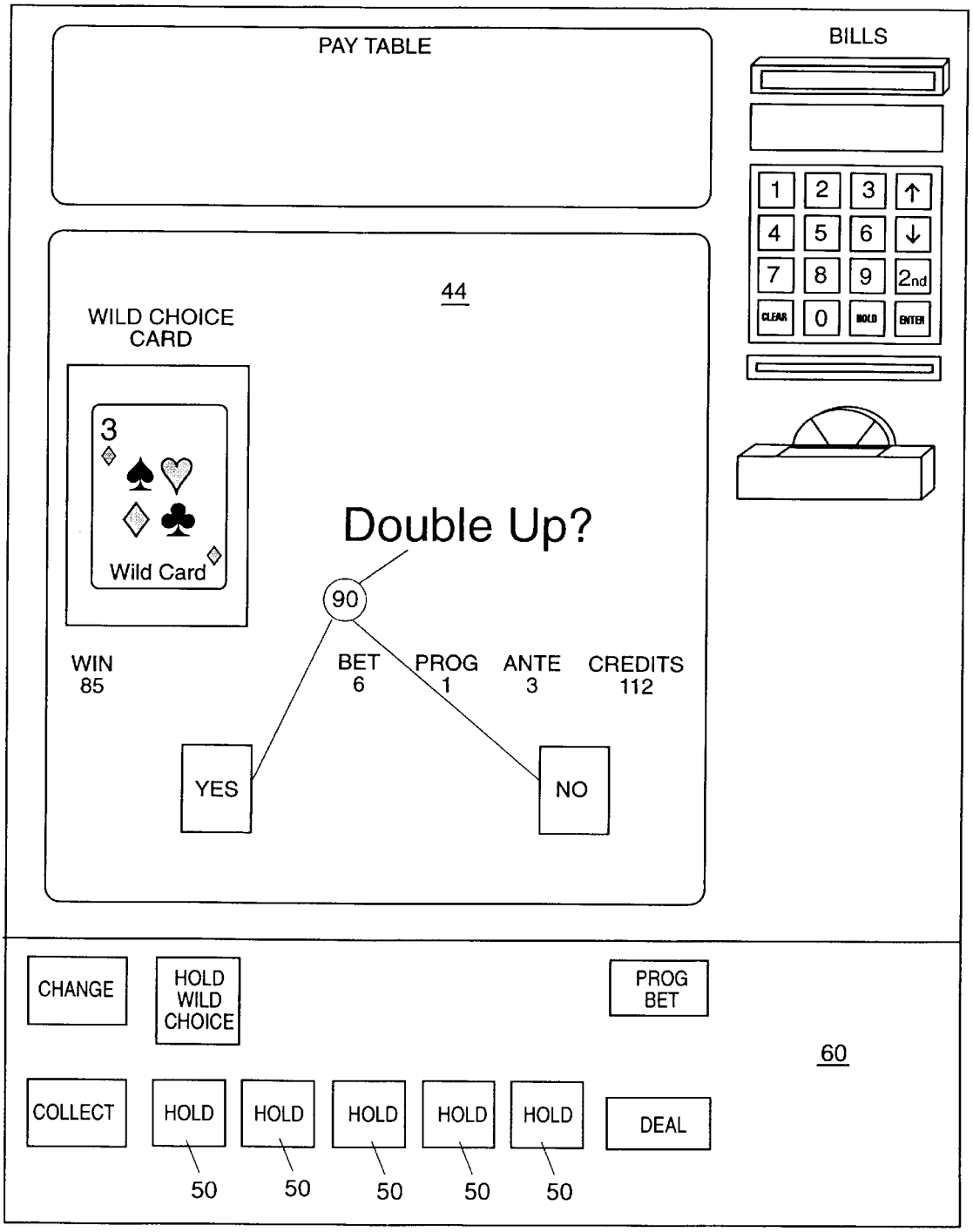
FIG. 8 is a schematic depiction of the play area of the gaming machine displaying a prompt to select a double or nothing option.

Moreover, and referring to FIG. 8, the player may preferably be provided with a double-or-nothing option at the end of a winning hand. On the gaming machine 10, a prompt 90 may be displayed in the play area 44 asking "double up?", a "yes" image is displayed above the leftmost hold button 50 and a "no" image is displayed above the rightmost hold button 50. The player communicates his/her decision to play the double-or-nothing option by actuating the leftmost or rightmost hold button 50 to respond "yes" or "no" respectively. Alternatively, and has been delineated supra, the player may interact with the gaming machine 10 by using a touch screen or other input device to select a "yes" or "no" image on the video screen 22. At the gaming table 100, the dealer provides the double-or-nothing option by communicating with the player.

Figure 9:
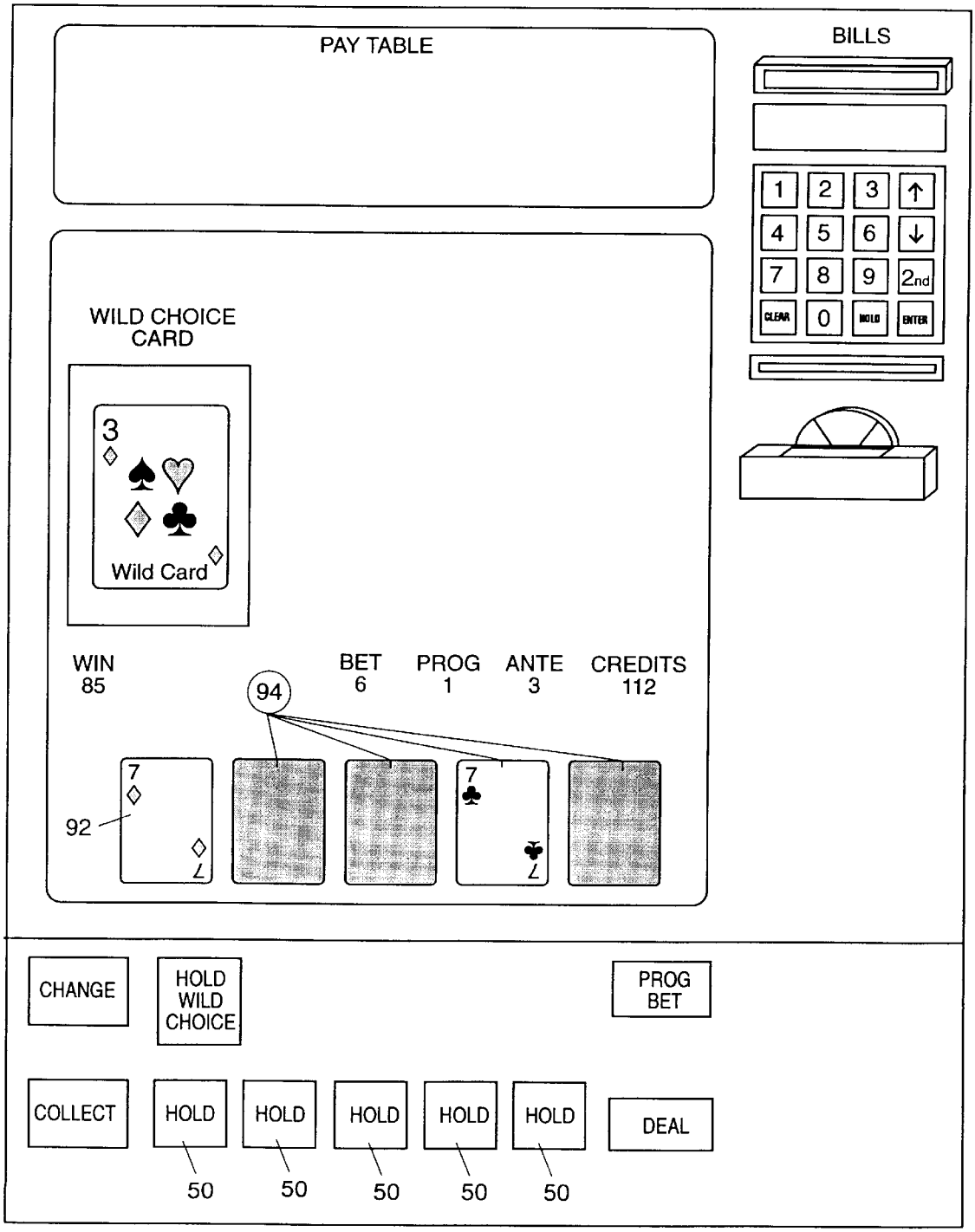
FIG. 9 is a schematic depiction of the play area of the gaming machine displaying a selection of a face down card which results in a "push".

Referring to FIGS. 1 and 9, the double-or-nothing option is played by dealing a first card 92 face up and a plurality of cards 94, preferably four, face down. The player chooses one of the face down cards 94 by pressing the corresponding hold button 50 on the gaming machine 10. If the card 94 selected by the player ranks higher than the first card 92, the winning pay out is doubled. Wild cards outrank all cards. A win increases the number of credits, chips or other item of monetary value provided to the player. If the selected card has a rank which is the same as the rank of the first card 92, a "push" occurs and the player must try again. Otherwise, the player loses. If the card 94 selected by the player does not outrank the first card 92, the player loses his/her winnings. This option may be randomly offered, always offered or offered at predetermined intervals. A wager may be required to play the double-or-nothing option or it may be offered freely or as an incentive to promote further play.

Furthermore, and referring to FIG. 2A, the gaming instrumentality may provide a "multiplier" option which, for example, multiplies the amount of a winning pay out by a randomly generated number. This option may be randomly offered, always offered or offered at predetermined intervals. A wager may be required to play the "multiplier" option or it may be offered freely or as an incentive to promote further play.

Figure 10:
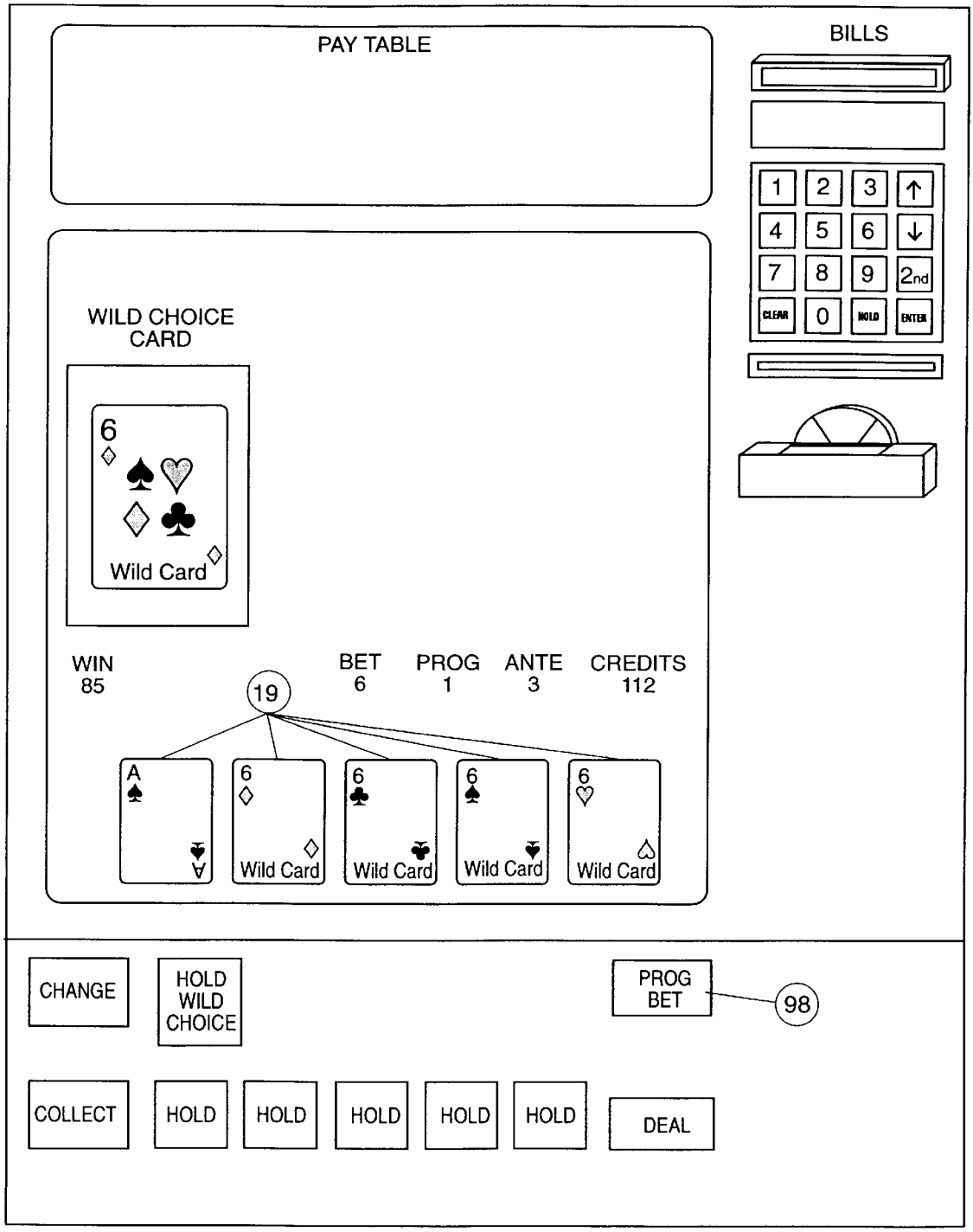
FIG. 10 is a schematic depiction of the play area of the gaming machine and a sample winning hand for the five ace of spades super progressive jackpot and a progressive bet button for placing a side wager.

Referring to FIG. 10, the game of the present invention provides a plurality of ways in which the player may partake in a "progressive jackpot" in which players at plural machines compete for a progressively growing award. Some examples, listed in order of highest-to-lowest pay out value, are:

1) five ace of spades super-progressive (FIG. 10).
2) five-of-a-kind.
3) four-of-a-kind without a wild card.
4) four-of-a-kind with a wild card.

A progressive side wager option may also be provided to the player. This option gives the player an opportunity to make a side wager on a progressive jackpot in anticipation of receiving a winning card combination listed on the predetermined pay out table 70. This may be accomplished by placing a wager and actuating the progressive bet button 51 on the gaming machine 10. Alternatively, progressive participation may be accomplished by the above enumerated input means.

In use and operation, assume a player initiates the game by an initial wager and then a plurality of cards are displayed to the player in one of the following fashions: face up, face down, revolving or in any combination thereof. Next, the player selects one of these cards as a wild card. Assume the wild card is the 3 of diamonds (please see FIG. 4). This card becomes displayed separately but is also returned to the deck with the other previously dealt cards to form a full deck of cards. Next, a hand is automatically dealt. Assume the hand holds the values of FIG. 5. Thus, the player has either a "4 card" straight or a "pair of 10s", depending on how the player values the "wild" 3 of hearts. Next, the player has the option to improve the hand by discarding unwanted cards. Assume the player discards the 4 of clubs (on the other hand, an "aggressive" player might attempt "5 of a kind" by keeping the "wild 3" and the "10 of hearts").

Figure 5A:
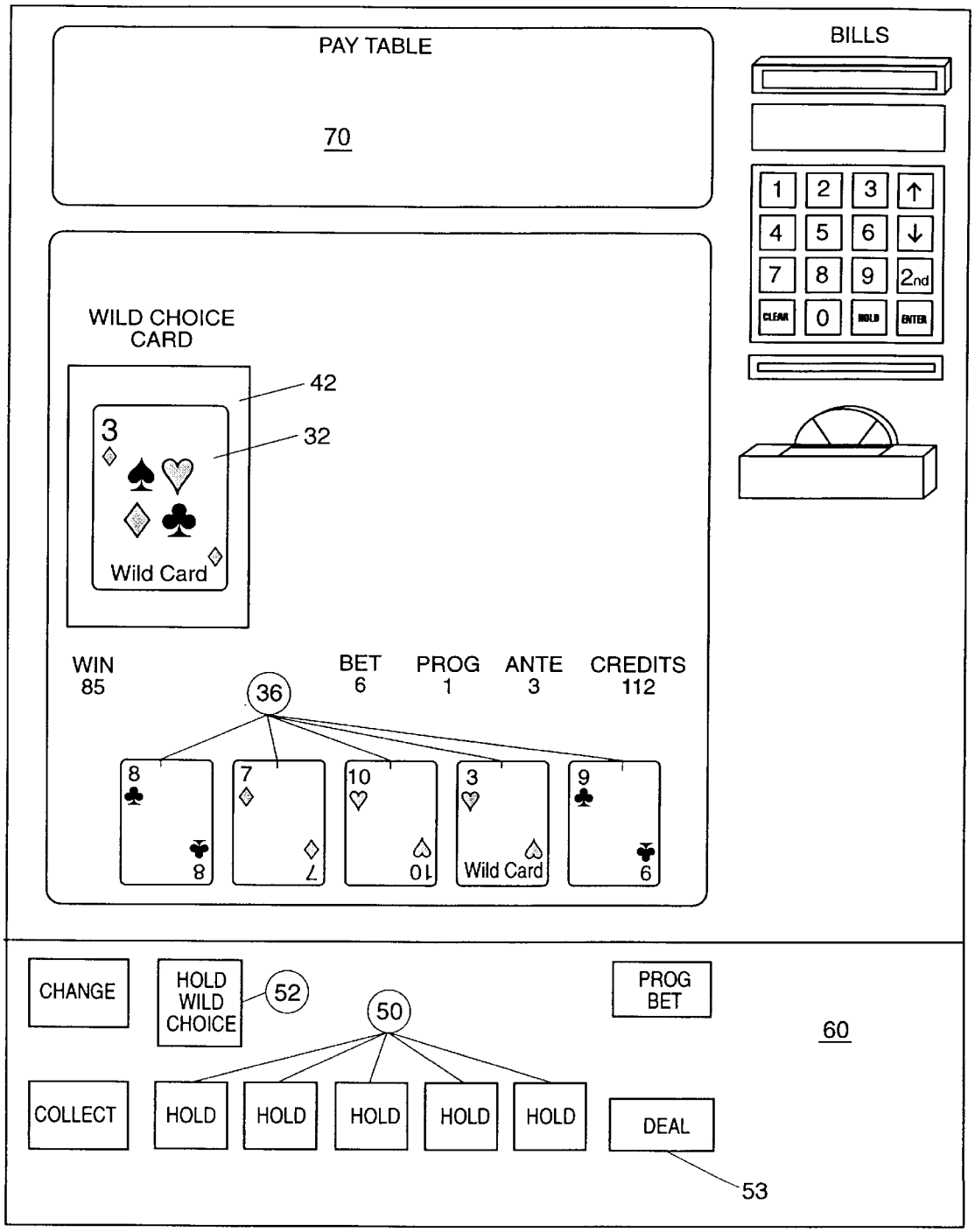
FIG. 5A is a schematic depiction of the play area of the gaming machine with a replacement card dealt after a first hand.

Referring to FIG. 5A, assume the player "fills" the straight by drawing the "8 of clubs". The player is a winner. Next the player has the option to double the winnings. The player may make a wager to enable this second level. Five cards are dealt, 1 face up (the "dealer's" card) and 4 face down. The player selects 1 of the 4 remaining face down cards. If this card, when exposed, is greater than the dealer's card, the player wins twice the pay table pay out rate for the "straight". A card less than the dealer's causes total loss to the player in the double up option. A tie or "push" requires the player to repeat the option to double the winning or forfeit his entire pot.

On the other hand, assume the player holds the "10 of hearts" and the "wild 3" and discards the other cards of FIG. 5. Assume further the player does not improve his hand via the replacement cards and therefore holds a "losing" hand. The player can next purchase (or is freely given at random) another wild card of different value. Assume the "5 of spades" is chosen by the player. If this new wild card matches a replacement card in his hand, the player has three "10s" which will be compared with the pay table to determine if a "winning" card combination has been obtained. For a "winning" hand, the player is provided with the option to double the winnings, a "losing" hand ends the game. Furthermore, the present invention may provide the player with the "multiplier" option at the end of a winning hand.

Referring to FIG. 2, the card game of the present invention may be played on an electronic gaming instrumentality 10 which includes a power supply means 134, a processor/controller 110, a random number generator 136 and a memory 120 having integral representation of the pay table 122, game criteria 124 and game graphics 126. Furthermore, a host computer 130 and an associated progressive display may be operatively coupled to the gaming instrumentality 10 for computing and displaying, inter alia,, a cumulative progressive jackpot value.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method for playing a card game, the steps including:

initiating play of the card game by a player making a wager;

displaying a first plurality of cards to the player, each of the first plurality of cards having a face value;

providing the player with an option to select by the player at least one of the first plurality of cards to be designated as a wild card prior to a player being dealt a first random hand from a full deck;

displaying the face value of at least the one designated wild card in a reserved area prior to playing the first random hand;

dealing the first hand of cards to the player from the full deck of cards including all designated wild cards therein;

comparing the value of at least the one designated wild card displayed in the reserved area with each of the values of the cards in the first hand to determine matching cards;

designating all matching cards in the first hand as wild cards to be used to define a best card hand according to a predetermined hierarchy of hands.

2. The method of claim 1 further including the step of providing the player with an option to interchange cards in the first hand with cards remaining in the deck of cards to form a second card hand.

3. The method of claim 1 further including the step of qualifying for a progressive jackpot by placing a side wager.

4. A method for playing a card game, the steps including:

initiating play of the card game by a player;

displaying a first plurality of cards to the player, each of the first plurality of cards having a face value;

providing the player with an option to select at least one of the first plurality of cards to be designated as a wild card;

displaying the face value of at least the one designated wild card in a reserved area;

dealing a first hand of cards to the player from a full deck of cards including all designated wild cards therein;

comparing the value of at least the one designated wild card with each of the values of the cards in the first hand to determine matching cards;

designating all matching cards in the first hand as wild cards to be used to define a best card hand according to a predetermined hierarchy of hands;

providing the player with an option to interchange cards in the first hand with cards remaining in the deck of cards to form a second card hand;

comparing the second card hand with a pay table and determining if the player has a winning hand according to winning combinations on the pay table; and further including the step of providing the player with an option to buy a second wild card if the second card hand fails to provide a winning combination in accordance with the pay table.

5. A method for playing a card game, the steps including:

initiating play of the card game by a player;

displaying a first plurality of cards to the player, each of the first plurality of cards having a face value;

providing the player with an option to select at least one of the first plurality of cards to be designated as a wild card;

displaying the face value of at least the one designated wild card in a reserved area;

dealing a first hand of cards to the player from a full deck of cards including all designated wild cards therein;

comparing the value of at least the one designated wild card with each of the values of the cards in the first hand to determine matching cards;

designating all matching cards in the first hand as wild cards to be used to define a best card hand according to a predetermined hierarchy of hands;

further including the step of providing the player with an option to interchange cards in the first hand with cards remaining in the deck of cards to form a second card hand;

further including the step of comparing the second card hand with a pay table and determining if the player has a winning hand according to winning combinations on the pay table;

further including the step of providing the player with an option to buy a second wild card if the second card hand fails to provide a winning combination in accordance with the pay table.

6. The method of claim 5 further including the step of comparing the value of the second wild card with each of the values of the cards in the second hand to determine all matching cards and designating all matching cards in the second hand as wild cards to be used to define a new second hand according to the predetermined hierarchy of hands.

7. The method of claim 6 further including the step of determining if the new second hand provides a winning combination in accordance with the pay table and paying the player according to a monetary value associated with each winning combination on the pay table.

8. The method of claim 5 further including the step of offering a double-up option to the player when the player is holding a winning card combination based on the pay table.

9. The method of claim 8 further including the step of allowing the player to respond to the double-up option.

10. The method of claim 9 further including the step of paying the player a monetary value for the winning second hand when the player responds no to the double-up option.

11. The method of claim 5 wherein the step of displaying a first plurality of cards to the player includes the step of rotating the cards about an axis.

12. A method for playing a card game, the steps including:

initiating play of the card game by a player;

displaying a first plurality of cards to the player, each of the first plurality of cards having a face value;

providing the player with an option to select at least one of the first plurality of cards to be designated as a wild card;

displaying the face value of at least the one designated wild card in a reserved area;

dealing a first hand of cards to the player from a full deck of cards including all designated wild cards therein;

comparing the value of at least the one designated wild card with each of the values of the cards in the first hand to determine matching cards;

designating all matching cards in the first hand as wild cards to be used to define a best card hand according to a predetermined hierarchy of hands;

further including the step of providing the player with an option to interchange cards in the first hand with cards remaining in the deck of cards to form a second card hand;

further including the step of comparing the second card hand with a pay table and determining if the player has a winning hand according to winning combinations on the pay table;

further including the step of offering a double-up option to the player when the player is holding a winning card combination based on the pay table;

further including the step of allowing the player to respond to the double-up option;

further including the step of dealing a double-up hand to the player, when the player responds yes to the double-up option, the double-up hand including at least one card dealt face up and the remaining cards dealt face down.

13. The method of claim 12 further including the step of allowing the player to choose at least one of the face down cards in the double-up hand and determining if this chosen card out ranks the face up card in the double-up hand.

14. The method of claim 13 further including the step of doubling the second winning hand pay out to the player when the chosen card out ranks the face up card in the double-up hand.

15. The method of claim 14 further including the steps of reoffering the double-up option to the player when the chosen card is equal in rank to the face up card and allowing the player to respond to the reoffered double-up option.

16. The method of claim 15 further including the steps of ending game play without pay out when the player responds no to the reoffered double-up option and playing a subsequent double-up hand when the player responds yes to the reoffered double-up option.

17. A method for playing video poker, the steps including:

having a player make a wager;

displaying a first plurality of cards to the player, each of the first plurality of cards having a face value;

selecting by the player a card from the first plurality of cards and designating said card as a wild card prior to the player being dealt a first random hand from a full deck;

receiving the first random hand from the full deck;

evaluating the hand including if the designated wild card is present based on a pay table; and further playing the poker game.

18. The method of claim 17 including having all cards of similar numerical face value designated as wild cards.

19. The method of claim 17 further including the steps of providing another wild card.

20. A method for playing video poker, the steps including:

placing a wager;

selecting a card from the first plurality of cards and designating said card as a wild card;

receiving a random hand from a full deck;

displaying a first plurality of cards to the player, each of the first plurality of cards having a face value;

evaluating the hand including if the designated wild card is present based on a pay table;

further playing the poker game;

including having all cards of similar numerical face value designated as wild cards; and playing by drawing cards to improve the hand and ranking the hand to the pay table and determining the existence of an award and providing an option to buy a second wild card if the hand fails to provide a winning combination in accordance with the pay table.

21. The method of claim 20 further including the steps of providing another wild card.

22. An apparatus for video poker, comprising, in combination:

means for receiving input from a player including wager input means and strategy selection input means;

award output means to award successful play;

random card generating means coupled to a display accessible to the player and responsive to both said player input means and output means;

and wild card selection means accessible to the player and coupled to said apparatus comprising a means for displaying a first plurality of cards to the player, each of the first plurality of cards having a face value, a means for selecting by a player at least one wild card from the first plurality of cards prior to the player receiving further cards.

23. The apparatus of claim 22 including progressive bet means to link plural player apparatus to a common award.

24. A method for playing video poker, the steps including:

having a player make a wager;

displaying a first plurality of cards to the player, each of the first plurality of cards having a face value;

selecting by the player a card from the first plurality of cards and designating the player selected card as a first wild card prior to the player being dealt a first random hand from a full deck of cards;

receiving the random first hand of cards from the full deck of cards including all designated wild cards;

assigning a wild card value to each card in the first hand which matches the designated first wild card for defining a resultant first poker hand according to a predetermined hierarchy of hands.

25. The method of claim 24 further including the step of providing the player with an option to exchange cards in the first hand with cards remaining in the deck of cards to form a second card hand.

26. The method of claim 25 further including the step of assigning a wild card value to each card in the second hand which matches the designated first wild card for defining a resultant second poker hand according to a predetermined hierarchy of hands.

27. The method of claim 26 further including the step of comparing the second poker hand with a pay table and determining if the player has a winning hand according to winning combinations on the pay table.

28. The method of claim 27 further including the step of offering a double-up option when the second poker hand includes a winning card combination based on the pay table.

29. The method of claim 24 further including the steps of providing another wild card.

30. A method for playing video poker, the steps including:

placing a wager;

selecting a card from a plurality of cards and designating the selected card as a first wild card;

receiving a random first hand of cards from a full deck of cards including all designated wild cards;

assigning a wild card value to each card in the first hand which matches the designated first wild card for defining a resultant first poker hand according to a predetermined hierarchy of hands;

further including the step of providing the player with an option to exchange cards in the first hand with cards remaining in the deck of cards to form a second card hand;

including the step of assigning a wild card value to each card in the second hand which matches the designated first wild card for defining a resultant second poker hand according to a predetermined hierarchy of hands;

further including the step of comparing the second poker hand with a pay table and determining if the player has a winning hand according to winning combinations on the pay table;

further including the step of offering a double-up option when the second poker hand includes a winning card combination based on the pay table;

further including the step of dealing a double-up hand when the double-up option is accepted, the double-up hand including at least one card dealt face up and the remaining cards dealt face down.

31. The method of claim 30 further including the step of choosing at least one of the face down cards in the double-up hand and doubling the second winning hand pay out when the chosen card out ranks the face up card.

32. The method of claim 31 further including the step of cancelling the second winning hand pay out when the chosen card fails to out rank the face up card.

33. The method of claim 32 further including replaying the double-up option when the chosen card and the face up card have an identical rank.

34. The method of claim 30 further including the step of providing an award for the second poker hand which matches a winning combination on the pay table when the double-up option is declined.

35. The method of claim 30 further including the step of offering a multiplier option when the second hand includes a winning card combination based on the pay table.

36. The method of claim 35 further including the step of randomly generating a number and multiplying a winning pay out value associated with the winning second hand by the randomly generated number.

37. The method of claim 36 further including the step of providing an award according to the multiplied pay out value for the winning second hand.

38. The method of claim 30 wherein the step of placing a wager further includes the step of placing a progressive wager to compete for a progressive jackpot.

39. A method for playing video poker, the steps including:

placing a wager;

selecting a card from a plurality of cards and designating the selected card as a first wild card;

receiving a random first hand of cards from a full deck of cards including all designated wild cards;

assigning a wild card value to each card in the first hand which matches the designated first wild card for defining a resultant first poker hand according to a predetermined hierarchy of hands;

further including the step of providing the player with an option to exchange cards in the first hand with cards remaining in the deck of cards to form a second card hand;

further including the step of assigning a wild card value to each card in the second hand which matches the designated first wild card for defining a resultant second poker hand according to a predetermined hierarchy of hands;

further including the step of comparing the second poker hand with a pay table and determining if the player has a winning hand according to winning combinations on the pay table;

further including the step of providing an option to buy a second wild card if the second card hand fails to provide a winning combination in accordance with the pay table.

40. The method of claim 39 further including the step of assigning a wild card value to each card in the second hand which matches the designated second wild card for defining a third poker hand potentially benefiting from both the first wild card and the second wild card.

41. The method of claim 40 further including the step of determining if the third poker hand provides a winning combination in accordance with the pay table.

42. The method of claim 41 further including the step of offering a double-up option when the third poker hand includes a winning card combination based on the pay table.

43. The method of claim 42 further including the step of dealing a double-up hand when the double-up option is accepted, the double-up hand including at least one card dealt face up and the remaining cards dealt face down.

44. The method of claim 43 further including the step of choosing at least one of the face down cards in the double-up hand and doubling the third winning hand pay out when the chosen card out ranks the face up card.

45. The method of claim 44 further including the step of cancelling the third winning hand pay out when the chosen card fails to out rank the face up card.

46. The method of claim 45 further including the step of replaying the double-up option when the chosen card and the face up card have an identical rank.

47. The method of claim 41 further including the step of offering a multiplier option when the second hand includes a winning card combination based on the pay table.

48. The method of claim 47 further including the steps of multiplying a winning pay out value associated with the winning second hand by a randomly generated number and providing an award in an amount according to the multiplied pay out value.

49. A method for playing video poker, the steps including:

placing a wager;

selecting a card from a plurality of cards and designating the selected card as a first wild card;

receiving a random first hand of cards from a full deck of cards including all designated wild cards;

assigning a wild card value to each card in the first hand which matches the designated first wild card for defining a resultant first poker hand according to a predetermined hierarchy of hands;

further including the step of providing the player with an option to exchange cards in the first hand with cards remaining in the deck of cards to form a second card hand;

further including the step of assigning a wild card value to each card in the second hand which matches the designated first wild card for defining a resultant second poker hand according to a predetermined hierarchy of hands;

further including the step of comparing the second poker hand with a pay table and determining if the player has a winning hand according to winning combinations on the pay table;

further including the step of providing a free bonus wild card if the second card hand fails to provide a winning combination in accordance with the pay table.

50. The method of claim 49 further including the step of assigning a wild card value to each card in the second hand which matches the bonus wild card for defining a third poker hand potentially benefiting from both the first wild card and the bonus wild card.

51. The method of claim 50 further including the step of determining if the third poker hand provides a winning combination in accordance with the pay table.

52. The method of claim 51 further including the step of offering a double-up option when the third poker hand includes a winning card combination based on the pay table.

53. The method of claim 52 further including the step of dealing a double-up hand when the double-up option is excepted, the double-up hand including at least one card dealt face up and the remaining cards dealt face down.

54. The method of claim 53 further including the step of choosing at least one of the face down cards in the double-up hand and doubling the third winning hand pay out when the chosen card out ranks the face up card.

55. The method of claim 54 further including the step of canceling the third winning hand pay out when the chosen card fails to out rank the face up card.

56. The method of claim 55 further including replaying the double-up option when the chosen card and the face up card have an identical rank.

57. The method of claim 51 further including the step of offering a multiplier option when the third poker hand includes a winning card combination based on the pay table.

58. The method of claim 57 further including the steps of multiplying a winning pay out value associated with the winning third poker hand by a randomly generated number and providing an award in an amount according to the multiplied pay out value.

59. The method of claim 52 further including the step of providing an award for the third poker hand which matches a winning combination on the pay table when the double-up option is declined.

60. A method for playing a card game, the steps including:

initiating play of the card game by a player;

designating a first wild card;

dealing a first hand of cards to the player from at least one deck of cards;

allowing the player to interchange cards in the first hand with cards remaining in the deck of cards to form a second card hand;

designating a second wild card;

designating cards in the second hand which match the first and second designated wild cards to define a best card hand according to a predetermined hierarchy of hands.

61. The method of claim 60 wherein designating a second wild card includes the step of providing the player with an option to buy the second wild card if the second card hand fails to provide a winning combination in accordance with a pay table.

62. A method for playing video poker, the steps including:

placing a wager;

selecting a card from a deck and designating said card as a wild card;

receiving a random hand from a full deck;

evaluating the hand including if the designated wild card is present based on a pay table;

further playing the poker game; and further including the step of dealing a double-up hand to the player, when the player responds yes to a double-up option, the double-up hand including at least one card dealt face up and the remaining cards dealt face down.

63. An apparatus for video poker, comprising, in combination:

means for receiving input from a player including wager input means and strategy selection input means;

award output means to award successful play;

random card generating means coupled to a display accessible to the player and responsive to both said player input means and output means;

and wild card selection means accessible to the player and coupled to said apparatus;

including means for dealing a double-up hand to the player, when the player responds yes to a double-up option, the double-up hand including at least one card dealt face up and the remaining cards dealt face down.

64. A method for playing video poker, the steps including:

placing a wager;

selecting a card from a plurality of cards and designating the selected card as a first wild card;

receiving a random first hand of cards from a full deck of cards including all designated wild cards;

assigning a wild card value to each card in the first hand which matches the designated first wild card for defining a resultant first poker hand according to a predetermined hierarchy of hands; and further including the step of providing a second wild card if a resultant poker hand fails to provide a winning combination in accordance with a pay table.

65. An apparatus for video poker, comprising, in combination:

means for receiving input from a player including strategy selection means and wager input means;

wild card selection means coupled to a display accessible to the player comprising a means for displaying a first plurality of cards to the player, each of the first plurality of cards having a face value, a means for selecting by a player at least one wild card from the first plurality of cards prior to the player being dealt a first random hand from a full deck;

random card generating means coupled to said display for displaying the first random hand to the player from the full deck and responsive to said player input means for further play; and award output means to award successful play.

66. The apparatus of claim 65 further including means for providing a second wild card during poker play, said means for providing said second wild card coupled to said apparatus.

* * * * *